US006981493B1

(12) United States Patent
Poteracke

(10) Patent No.: US 6,981,493 B1
(45) Date of Patent: Jan. 3, 2006

(54) PAINTBALL BACKPACK

(76) Inventor: Charles J. Poteracke, 5992 Crestmore South East, Kenwood, MI (US) 49508

( * ) Notice: Subject to any disclaimer, the term of this patent is extended or adjusted under 35 U.S.C. 154(b) by 0 days.

(21) Appl. No.: 10/926,200

(22) Filed: Aug. 26, 2004

(51) Int. Cl.
*F41B 11/02* (2006.01)

(52) U.S. Cl. ..... 124/51.1; 124/45; 124/49; 222/175; 224/931

(58) Field of Classification Search ..... 124/45, 124/49, 50, 51.1; 221/185; 222/175; 224/931
See application file for complete search history.

(56) References Cited

U.S. PATENT DOCUMENTS

| | | | | |
|---|---|---|---|---|
| 467,074 A | * | 1/1892 | Anerson et al. | 222/175 |
| 2,266,334 A | | 12/1941 | Rice | |
| 2,599,118 A | * | 6/1952 | McMillan | 222/175 |
| 2,973,124 A | * | 2/1961 | Lee | 222/513 |
| 5,086,948 A | * | 2/1992 | Slusarz | 221/185 |
| 5,282,454 A | | 2/1994 | Bell et al. | |
| 5,360,142 A | | 11/1994 | Stern et al. | |
| 5,503,090 A | | 4/1996 | Guzan | |
| 5,529,220 A | | 6/1996 | Credle, Jr. et al. | |
| 5,809,983 A | | 9/1998 | Stoneking | |
| 5,921,435 A | | 7/1999 | Billet | |
| 6,055,975 A | | 5/2000 | Gallagher et al. | |
| D428,249 S | | 7/2000 | Ash, Jr. | |
| 6,508,384 B1 | | 1/2003 | Tien et al. | |

* cited by examiner

*Primary Examiner*—John A. Ricci

(57) ABSTRACT

A paintball backpack includes a housing including a plurality of isolated compartments having open top end portions. The compartments include a plurality of releasable flap portions connected adjacent the top end portions. The housing further has a lower cavity provided with an outlet positioned substantially medially thereof. The lower cavity is disposed subjacent the compartments and has a bottom surface sloping downwardly and inwardly towards the outlet. The backpack further includes a harness including a plurality of shoulder portions adjacent the flap portions of the housing and extending about a user's torso and a belt section integral therewith. The backpack further includes a mechanism for selectively moving paintballs from the top end portions to the lower cavity and a mechanism for dispensing paintballs outwardly and away from the lower cavity wherein the paintballs are projected from the housing at a predetermined velocity.

20 Claims, 3 Drawing Sheets

PAINTBALL BACKPACK

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a paintball storage containers and, more particularly, to a paintball backpack for storing and dispensing paintballs during a paintball game.

2. Prior Art

When engaged in any one of the numerous varieties of paintball games, one player attempts to hit another player with a spherical ball containing paint or some other type of marking material discharged from a compressed air or gas operated marking device. It is often advantageous to be able to fire rapidly and continuously in order to increase the chances of hitting an opponent with a paintball.

Although the compressed gas cylinders used to propel the paintballs can provide up to 1000 or more individual charges or shots, the magazines or hoppers attached to the paintball markers typically are limited to holding only about one or two hundred paintballs. This can create an undesirable situation wherein a player has sufficient compressed gas to continue shooting, but runs out of paintball ammunition.

In this scenario, a player without paintball ammunition is particularly vulnerable insofar as the distinctive sound of a paintball marker being fired with an empty hopper is easily recognized by other players. As a result, an opponent can rush upon and shoot the player with the empty marker without risk of being shot by that player.

In order to reduce the chance of being caught with an empty paintball hopper, paintball canisters holding about 100 paintballs have been made available to paintball enthusiasts. Several of these canisters are typically carried on a belt and are removed, opened and emptied into a paintball marker hopper before the hopper runs out of paintballs.

While such canisters provide an advantage, they are often difficult to access, open and dispense. Moreover, the opening of these canisters usually requires the use of two hands and thereby temporarily renders the player defenseless.

Another drawback associated with such canisters is the problem of their proper disposal. Once emptied, the canisters present disposal and potential safety issues. Proper disposal of the canister requires a player to reapply the canister's cap or cover and place it back into a pouch on the player's belt. As with dispensing the paintballs into a paintball marker hopper, this leaves the player defenseless for a brief period of time, thus providing more opportunity for an opposing player to score a mark.

An alternate means of disposal would be for the player to throw the empty canister on the ground in the playing area for later retrieval. This method can pose a safety problem. In the heat of action, a player, other team members or opponents could step on an empty canister, causing them to fall.

Accordingly, a need remains for a portable paintball container that stores and dispenses paintballs quickly and easily while playing a paintball game. The present invention fulfills such a need by providing a portable backpack capable of storing numerous paintballs and dispensing them quickly and efficiently as a user desires. The present invention decreases the number of times a user must reload and enables a user to carry surplus paint balls effortlessly for long periods of time.

BRIEF SUMMARY OF THE INVENTION

In view of the foregoing background, it is therefore an object of the present invention to provide an apparatus for storing and dispensing paintballs that can be worn by a user without inhibiting movement. These and other objects, features, and advantages of the invention are provided by a backpack including a housing including a plurality of isolated compartments having open top end portions for receiving paintballs therethrough. The compartments include a plurality of releasable flap portions connected adjacent the top end portions and being provided with a plurality of fasteners for selectively adjusting the housing between open and closed positions. The housing further has a lower cavity provided with an outlet positioned substantially medially thereof. The lower cavity is disposed subjacent the compartments and has a bottom surface sloping downwardly and inwardly towards the outlet.

The backpack further includes a harness formed from flexible material including a plurality of shoulder portions adjacent the flap portions of the housing and extending about a user's torso. The harness includes a belt section integral therewith and extending about a user's waist for adjustably tightening or loosening the harness.

The backpack further includes a mechanism for selectively moving paintballs from the top end portions to the lower cavity and a mechanism for dispensing paintballs outwardly and away from the lower cavity wherein the paintballs are projected from the housing at a predetermined velocity.

The moving mechanism includes a plurality of trap doors pivotally attached to the compartments respectively and being disposed above the lower cavity. A plurality of flexible pull cords having opposed end portions are connected to the trap doors and are freely movable along the harness respectively. The pull cords selectively cause the plurality of trap doors to toggle between open and closed positions and along an arcuate path and include a plurality of ring portions connected to one end portion thereof and for assisting a user to operate the trap doors during operating conditions.

The dispensing mechanism includes an elongated conduit formed from flexible material so that a user can selectively adapt a shape thereof. The conduit has proximal and distal portions connected to the outlet and extending downwardly and away therefrom respectively. A clip is connected to the belt section for receiving and maintaining the distal end of the conduit at a substantially stationary position during operating conditions. The dispensing mechanism further includes an electric motor positioned within the housing and having an output shaft extending vertically therefrom and into the lower cavity.

The dispensing mechanism further includes a propeller operably connected to the shaft and being disposed adjacent the outlet for directing paintballs therethrough and into the conduit. The propeller is rotatable in a selected radial path as the shaft rotates in a corresponding direction. A power source including a battery pack is disposed within the housing and electrically coupled to the motor.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
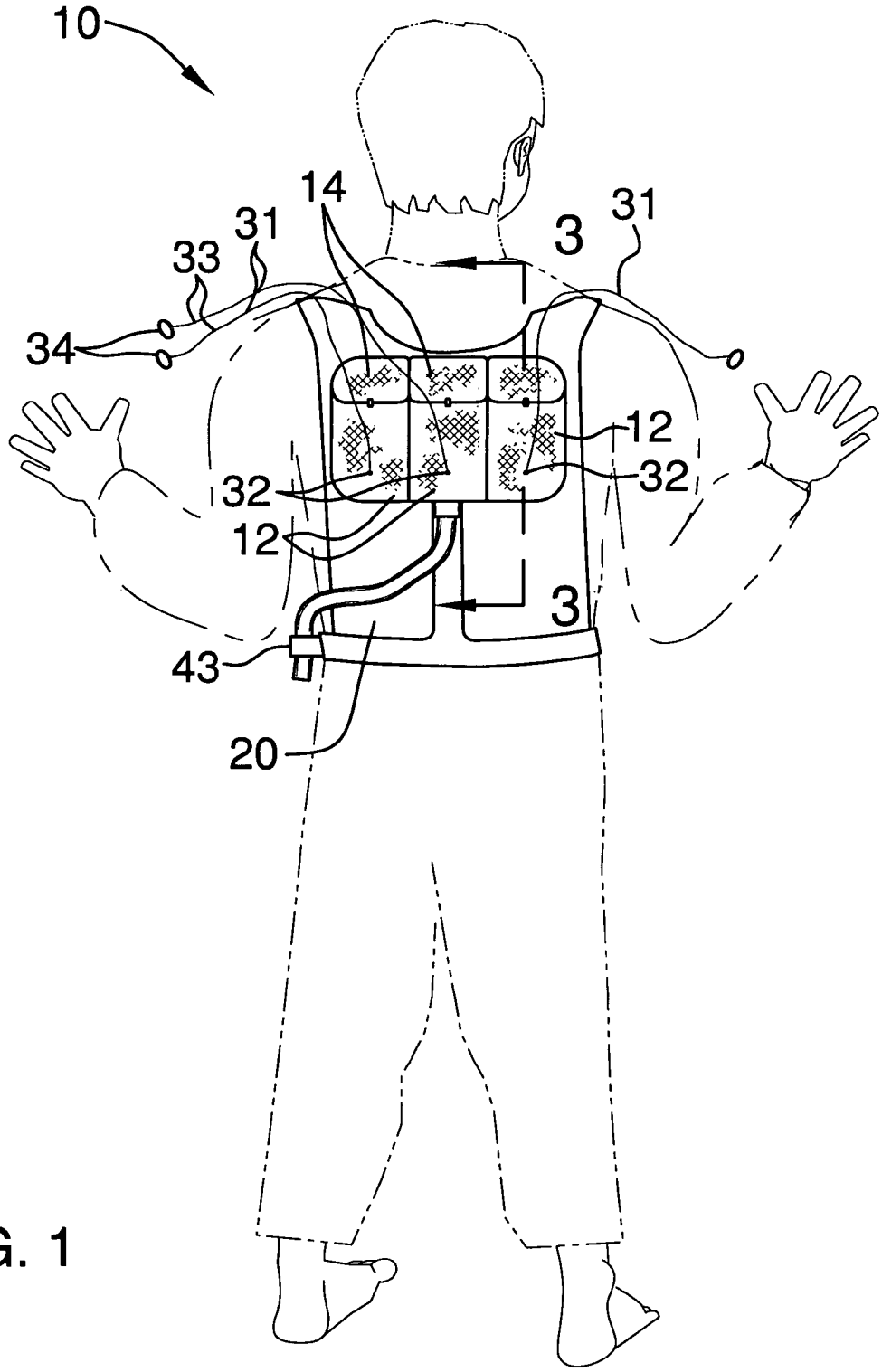
FIG. 1 is a rear-end view showing a paintball backpack in a preferred environment, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–4 by the reference numeral 10 and is intended to provide a paintball backpack for storing and dispensing paintballs. It should be understood that the backpack 10 may be used to store and dispense many different types of objects and should not be limited to only paintballs.

Figure 3:
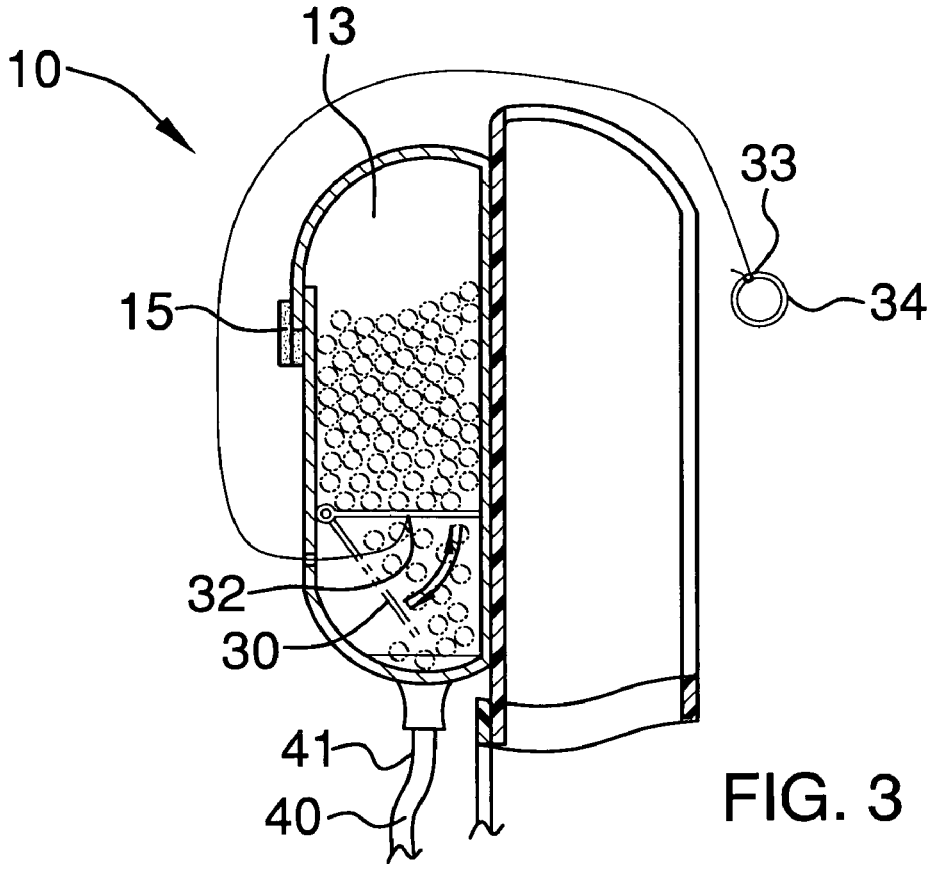
FIG. 3 is a cross-sectional view of the present invention, taken along line 3—3.
Figure 4:
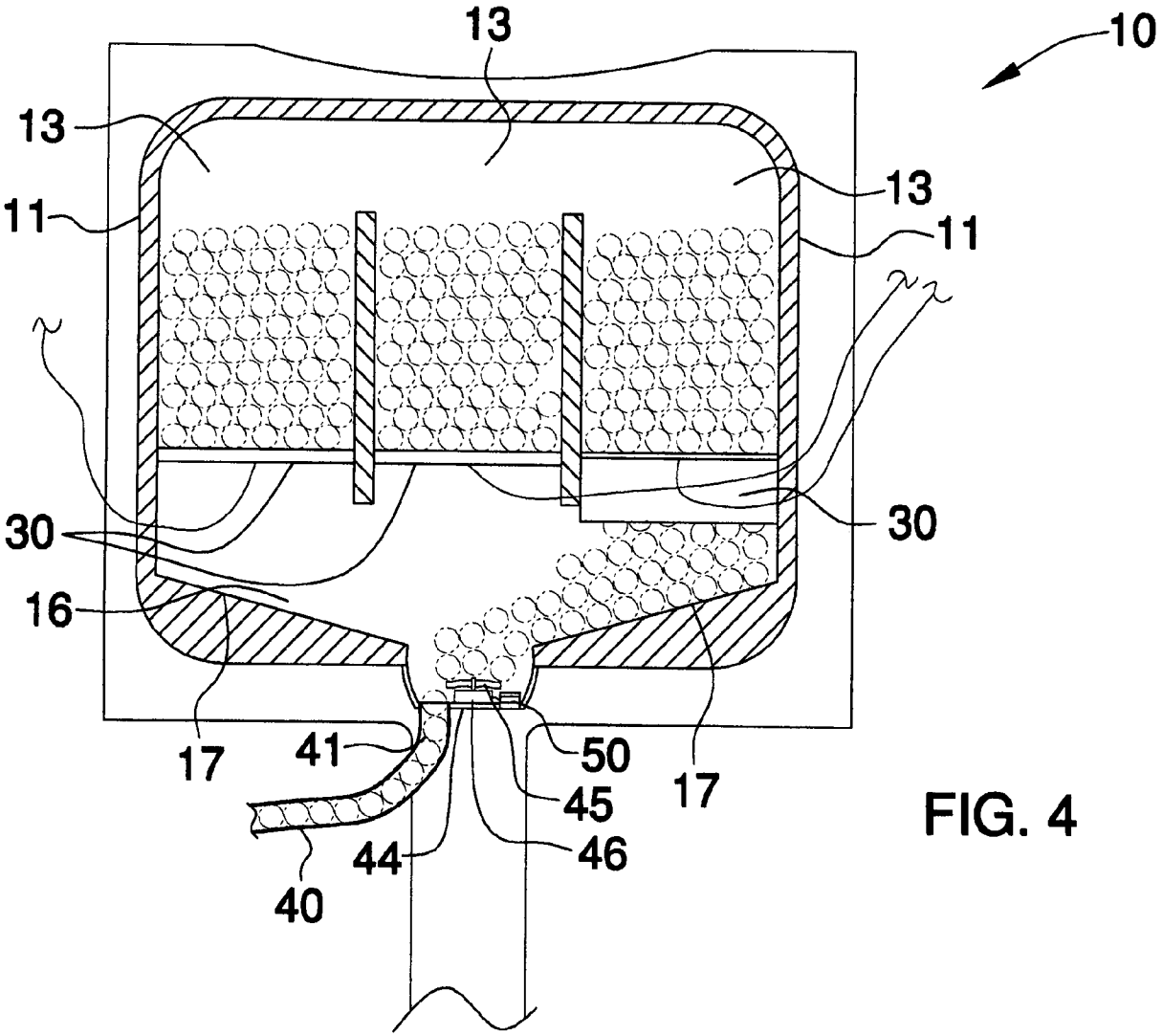
FIG. 4 is a cross-sectional view of the backpack illustrating the movement of paint balls from the compartments into the conduit, taken along line 4—4.

Initially referring to FIGS. 3 and 4, the backpack 10 includes a housing 11 including a plurality of isolated compartments 12 having open top end portions 13 for receiving paintballs therethrough. The compartments 12 include a plurality of releasable flap portions 14 connected adjacent the top end portions 13 and being provided with a plurality of fasteners 15 for selectively adjusting the housing 11 between open and closed positions. The fasteners 15 are preferably formed from Velcro material as well known in the industry so that a user can easily open and close the flaps 14 when replenishing paintballs. The housing 11 further has a lower cavity 16 provided with an outlet 17 positioned substantially medially thereof. The lower cavity 16 is disposed subjacent the compartments 12 and has a bottom surface 17 sloping downwardly and inwardly towards the outlet 17. The sloping surface 17 assists in directing paintballs released from the compartments 12 downwardly to the outlet 17 by force of gravity.

Figure 2:
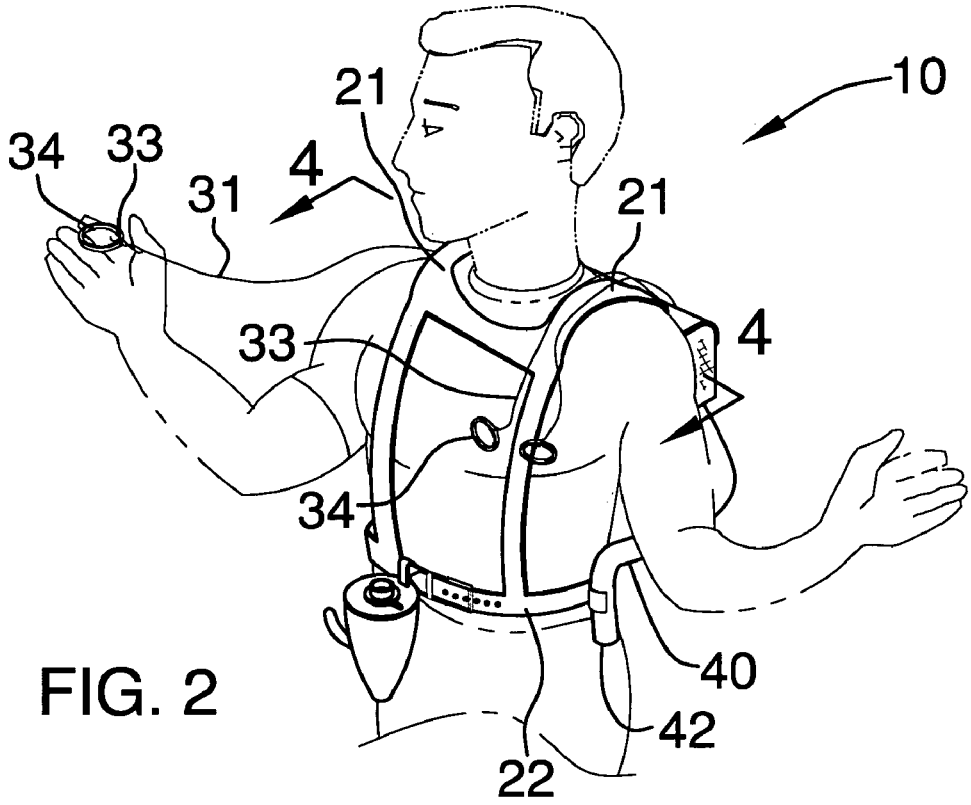
FIG. 2 is a perspective view of the present invention showing the shoulder harness and belt.

Now referring to FIGS. 1 and 2, the backpack 10 further includes a harness 20 formed from flexible material including a plurality of shoulder portions 21 adjacent the flap portions 14 of the housing 11 and extending about a user's torso. The harness 20 includes a belt section 22 integral therewith and extending about a user's waist for adjustably tightening or loosening the harness 20. The harness 20 ensures that the backpack 10 fits tightly about a user's torso so that an opponent's target area is diminished.

Now referring to FIG. 4, the backpack 10 further includes a mechanism for selectively moving paintballs from the top end portions 13 to the lower cavity 16 and a mechanism for dispensing paintballs outwardly and away from the lower cavity 16 wherein the paintballs are projected from the housing 11 at a predetermined velocity.

Now referring to FIGS. 3 and 4, the moving mechanism includes a plurality of trap doors 30 pivotally attached to the compartments 12 respectively and being disposed above the lower cavity 16. A plurality of flexible pull cords 31 having opposed end portions 32, 33 are connected to the trap doors 30 and are freely movable along the harness 20 respectively. The pull cords 31 selectively cause the plurality of trap doors 30 to toggle between open and closed positions and along an arcuate path as shown in FIG. 3, and include a plurality of ring portions 34 connected to one end portion 33 thereof and for assisting a user to operate the trap doors 30 during operating conditions. Advantageously, the ring portion 34 enables a user to quickly and easily grasp a pull cord 31 for releasing additional paintballs from the compartments 12 as needed.

Now referring to FIG. 4, the dispensing mechanism includes an elongated conduit 40 formed from flexible material so that a user can selectively adapt a shape thereof. The conduit has proximal 41 and distal 42 portions connected to the outlet 17 and extending downwardly and away therefrom respectively. A clip 43 is connected to the belt section 22 for receiving and maintaining the distal end 42 of the conduit 40 at a substantially stationary position within easy reach of a user during operating conditions, as shown in FIG. 2. The dispensing mechanism further includes an electric motor 44 positioned within the housing 11 and having an output shaft 45 extending vertically therefrom and into the lower cavity 16.

Still referring to FIG. 4, the dispensing mechanism further includes a propeller 46 operably connected to the shaft 45 and being disposed adjacent the outlet 17 for directing paintballs therethrough and into the conduit 40. The propeller 46 is rotatable in a selected radial path as the shaft 45 rotates in a corresponding direction. A power source 50 including a battery pack is disposed within the housing 11 and electrically coupled to the motor 44 for providing power in remote locations.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A backpack for storing and dispensing paintballs, said backpack comprising:

a housing comprising a plurality of isolated compartments having open top end portions for receiving paintballs therethrough, said compartments comprising a plurality of releasable flap portions connected adjacent the top end portions for selectively adjusting the housing between open and closed positions, said housing further having a lower cavity provided with an outlet positioned substantially medially thereof, said lower cavity being disposed subjacent said compartments and having a bottom surface sloping downwardly and inwardly towards the outlet;

a harness connected to said housing and extending about a user's torso, said harness including a belt section integral therewith and extending about a user's waist for adjustably tightening or loosening said harness;

means for selectively moving paintballs from said top end portions to said lower cavity; and means for dispensing paintballs outwardly and away from said lower cavity wherein the paintballs are projected from the housing at a predetermined velocity.

2. The backpack of claim 1, wherein said dispensing means comprises:

an elongated conduit having proximal and distal portions connected to the outlet and extending downwardly and away therefrom respectively;

an electric motor positioned within said housing and having an output shaft extending vertically therefrom and into said lower cavity;

a propeller operably connected to said shaft and being disposed adjacent the outlet for directing paintballs therethrough and into said conduit, said propeller being rotatable in a selected radial path as said shaft rotates in a corresponding direction; and a power source disposed within said housing and electrically coupled to said motor.

3. The backpack of claim 1, wherein said moving means comprises:

a plurality of trap doors pivotally attached to said compartments respectively and being disposed above said lower cavity; and a plurality of flexible pull cords having opposed end portions connected to said trap doors and freely movable along said harness respectively, said pull cords for selectively causing said plurality of trap doors to toggle between open and closed positions and along an arcuate path, said pull cords comprising a plurality of ring portions connected to one said end portions thereof and for assisting a user to operate said trap doors during operating conditions.

4. The backpack of claim 2, wherein said power source comprises: a battery pack.

5. The backpack of claim 2, wherein said conduit is formed from flexible material so that a user can selectively adapt a shape thereof.

6. The backpack of claim 2, wherein said dispensing means further comprises:

a clip connected to said belt section for receiving and maintaining said distal end of said conduit at a substantially stationary position during operating conditions.

7. The backpack of claim 2, wherein said conduit is formed from flexible material so that a user can selectively adapt a shape thereof.

8. A backpack for storing and dispensing paintballs, said backpack comprising:

a housing comprising a plurality of isolated compartments having open top end portions for receiving paintballs therethrough, said compartments comprising a plurality of releasable flap portions connected adjacent the top end portions for selectively adjusting the housing between open and closed positions, said housing further having a lower cavity provided with an outlet positioned substantially medially thereof, said lower cavity being disposed subjacent said compartments and having a bottom surface sloping downwardly and inwardly towards the outlet;

a harness comprising a plurality of shoulder portions adjacent said flap portions of said housing and extending about a user's torso, said harness including a belt section integral therewith and extending about a user's waist for adjustably tightening or loosening said harness;

means for selectively moving paintballs from said top end portions to said lower cavity; and means for dispensing paintballs outwardly and away from said lower cavity wherein the paintballs are projected from the housing at a predetermined velocity.

9. The backpack of claim 8, wherein said dispensing means comprises:

an elongated conduit having proximal and distal portions connected to the outlet and extending downwardly and away therefrom respectively;

an electric motor positioned within said housing and having an output shaft extending vertically therefrom and into said lower cavity;

a propeller operably connected to said shaft and being disposed adjacent the outlet for directing paintballs therethrough and into said conduit, said propeller being rotatable in a selected radial path as said shaft rotates in a corresponding direction; and a power source disposed within said housing and electrically coupled to said motor.

10. The backpack of claim 8, wherein said moving means comprises:

a plurality of trap doors pivotally attached to said compartments respectively and being disposed above said lower cavity; and a plurality of flexible pull cords having opposed end portions connected to said trap doors and freely movable along said harness respectively, said pull cords for selectively causing said plurality of trap doors to toggle between open and closed positions and along an arcuate path, said pull cords comprising a plurality of ring portions connected to one said end portions thereof and for assisting a user to operate said trap doors during operating conditions.

11. The backpack of claim 9, wherein said power source comprises: a battery pack.

12. The backpack of claim 9, wherein said dispensing means further comprises:

a clip connected to said belt section for receiving and maintaining said distal end of said conduit at a substantially stationary position during operating conditions.

13. The backpack of claim 8, wherein said harness is formed from flexible material.

14. A backpack for storing and dispensing paintballs, said backpack comprising:

a housing comprising a plurality of isolated compartments having open top end portions for receiving paintballs therethrough, said compartments comprising a plurality of releasable flap portions connected adjacent the top end portions and being provided with a plurality of fasteners for selectively adjusting the housing between open and closed positions, said housing further having a lower cavity provided with an outlet positioned substantially medially thereof, said lower cavity being disposed subjacent said compartments and having a bottom surface sloping downwardly and inwardly towards the outlet;

a harness comprising a plurality of shoulder portions adjacent said flap portions of said housing and extending about a user's torso, said harness including a belt section integral therewith and extending about a user's waist for adjustably tightening or loosening said harness;

means for selectively moving paintballs from said top end portions to said lower cavity; and means for dispensing paintballs outwardly and away from said lower cavity wherein the paintballs are projected from the housing at a predetermined velocity.

15. The backpack of claim 14, wherein said dispensing means comprises:

an elongated conduit having proximal and distal portions connected to the outlet and extending downwardly and away therefrom respectively;

an electric motor positioned within said housing and having an output shaft extending vertically therefrom and into said lower cavity;

a propeller operably connected to said shaft and being disposed adjacent the outlet for directing paintballs therethrough and into said conduit, said propeller being rotatable in a selected radial path as said shaft rotates in a corresponding direction; and a power source disposed within said housing and electrically coupled to said motor.

16. The backpack of claim 15, wherein said power source comprises: a battery pack.

17. The backpack of claim 15 wherein said conduit is formed from flexible material so that a user can selectively adapt a shape thereof.

18. The backpack of claim 15, wherein said dispensing means further comprises:

a clip connected to said belt section for receiving and maintaining said distal end of said conduit at a substantially stationary position during operating conditions.

19. The backpack of claim 14, wherein said moving means comprises:

a plurality of trap doors pivotally attached to said compartments respectively and being disposed above said lower cavity; and a plurality of flexible pull cords having opposed end portions connected to said trap doors and freely movable along said harness respectively, said pull cords for selectively causing said plurality of trap doors to toggle between open and closed positions and along an arcuate path, said pull cords comprising a plurality of ring portions connected to one said end portions thereof and for assisting a user to operate said trap doors during operating conditions.

20. The backpack of claim 14, wherein said harness is formed from flexible material.

* * * * *